US012304700B2

(12) United States Patent
Teillard

(10) Patent No.: US 12,304,700 B2
(45) Date of Patent: May 20, 2025

(54) METALLIZED HINGE CAP

(71) Applicant: ANOMATIC CORPORATION, Newark, OH (US)

(72) Inventor: Didier Marcel Teillard, New Albany, OH (US)

(73) Assignee: ANOMATIC CORPORATION, Newark, OH (US)

( * ) Notice: Subject to any disclaimer, the term of this patent is extended or adjusted under 35 U.S.C. 154(b) by 0 days.

(21) Appl. No.: 18/299,500

(22) Filed: Apr. 12, 2023

(65) Prior Publication Data

US 2023/0331442 A1 Oct. 19, 2023

Related U.S. Application Data

(60) Provisional application No. 63/363,062, filed on Apr. 15, 2022.

(51) Int. Cl.
*B65D 43/16* (2006.01)

(52) U.S. Cl.
CPC ..... *B65D 43/162* (2013.01); *B65D 2203/00* (2013.01)

(58) Field of Classification Search
CPC ..... B65D 43/162; B65D 2203/00; B65D 47/0838
See application file for complete search history.

(56) References Cited

U.S. PATENT DOCUMENTS 2,081,985 A 6/1937 Cornwell
4,452,373 A * 6/1984 Pearce ..... A45C 11/24 220/829
5,509,585 A * 4/1996 Mock ..... B65D 5/746 222/566
5,851,634 A 12/1998 Andersen et al.
10,421,589 B1 9/2019 Quinn
10,611,540 B2 4/2020 Lyzenga et al.
10,889,885 B2 * 1/2021 Perego ..... B23K 26/0006
11,278,989 B2 3/2022 Rudolf et al.
11,673,157 B2 6/2023 Perego
2009/0098345 A1 * 4/2009 Brasher ..... B32B 15/08 427/256
2013/0156995 A1 6/2013 Crutchley et al.

FOREIGN PATENT DOCUMENTS

EP 2522762 A1 11/2012
EP 2522762 B1 12/2013

OTHER PUBLICATIONS

International Search Report and Written Opinion issued Jul. 20, 2023 for international application No. PCT/US2023/018338, 15 pages.

* cited by examiner

*Primary Examiner* — James N Smalley
(74) *Attorney, Agent, or Firm* — Vorys, Sater, Seymour and Pease LLP; Mark A. Watkins

(57) ABSTRACT

The present disclosure relates to metalized hinge caps and/or the manufacturing thereof. One or more embodiment described herein includes a method of manufacturing a metalized hinge cap. The method can comprise applying a metallization process to a hinge cap to deposit a metal film onto a cap top, cap base, and hinge of the hinge cap. The he hinge can be integral with a first sidewall of the cap top. Further, the hinge can be integral with a second sidewall of the cap base. Also, the method can comprise removing the metal film from at least a portion of hinge via an ablation of the metal film.

6 Claims, 4 Drawing Sheets

METALLIZED HINGE CAP

CROSS REFERENCE TO RELATED APPLICATIONS

This application claims priority to and the benefit of U.S. Provisional Application No. 63/363,062 filed Apr. 15, 2022 and titled "Metallized Hinge Cap", which is hereby incorporated by reference herein in its entirety.

BACKGROUND

Hinge caps or flip-top lids allow opening and closing of a cap without dissembling the cap from a container body. Many flip-top lids for containers (e.g., shampoo containers) include a living hinge. Generally, a living hinge (or integral hinge) is a thin, flexible hinge made from the same material as two rigid pieces of material to which the hinge connects. The living hinge is typically thinned, or cut, to enable bending.

There is a demand to provide a metallic high-end aesthetic to container flip top lids with a living hinge. However, metalizing the entire surface, including the living hinge, can face numerous challenges. For example, during usage the hinge flexes and stretches such that the applied metallization cracks or flakes off the product, making the container lid unattractive. Additionally, the flaking can cause product contamination. Other metalized lids use a masking technique to hide the living hinge during the metallization process. These masking techniques are costly and time consuming and may interfere with the adhesion of subsequent coatings.

SUMMARY OF DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to one embodiment of the present disclosure, a method of manufacturing a metalized hinge cap is provided. The method can comprise applying a metallization process to a hinge cap to deposit a metal film onto a cap top, cap base, and hinge of the hinge cap. The hinge can be integral with a first sidewall of the cap top. Further, the hinge can be integral with a second sidewall of the cap base. Also, the method can comprise removing the metal film from at least a portion of hinge via an ablation of the metal film.

In accordance with another embodiment of the present disclosure, another method of manufacturing a metalized hinge cap is provided. The method can comprise depositing a metal film onto a surface area of a hinge cap. The metal film can be deposited onto a cap top, base top, and integral hinge of the hinge cap. The method can also comprise laser ablating the integral hinge to remove a portion of the metal film. The laser ablating follows a pre-defined travel route along the surface area of the hinge cap.

In accordance with another embodiment of the present disclosure, a metalized hinge cap is provided. The metalized hinge cap can comprise a cap base coupled to a cap top by a hinge. A first end of the hinge is integral with a sidewall of the cap base. Also, a second end of the hinge is integral with a sidewall of the cap top. The metalized hinge cap can further comprise a metal film positioned on a surface area of the cap top and a surface area of the cap base, wherein the metal film is absent from at least a portion of the hinge.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to vacuum metallizing/metallic coating processes and, more particularly, to metallization of plastic caps with a living hinge. The living hinge can enable opening and closing of the cap without dissembling it from the body of the packaging.

Figure 1A:
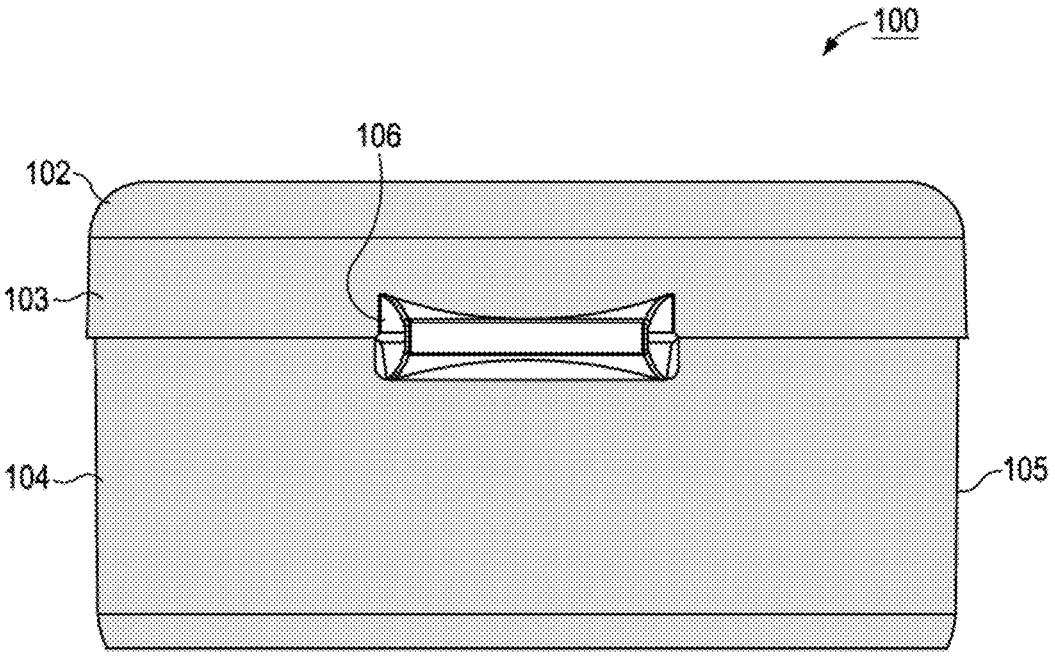
FIG. 1A illustrates a diagram of a side perspective a non-limiting example hinge cap in accordance with one or more embodiments described herein.
Figure 1B:
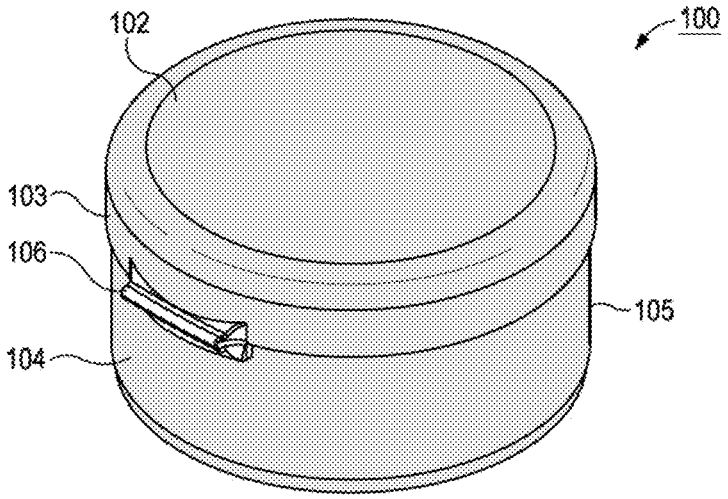
FIG. 1B illustrates a diagram of an example non-limiting hinge cap in accordance with one or more embodiments described herein.

FIGS. 1A-1B illustrate a non-limiting example hinge cap 100 in accordance with one or more embodiments described herein. The hinge cap 100 can include a cap top 102 having a top sidewall 103 and cap base 104 having a base sidewall 105. The cap top 102 and cap base 104 are connected together via a strip of material having a first end connected to the top sidewall 103 and a second end connected to the base sidewall 105 to form an integral hinge 106. For example, the first end can be integral with the top sidewall 103 of the cap top 102, and the second end can be integral with the base sidewall 105 of the cap base 104.

The cap top 102 and the cap base 104 can be configured to have a snap fit connection. For example, when the cap top 102 engages the cap base 104 in a closed position, the cap top 102 and the cap base 104 can remain in a sealed contact until a sufficient force is applied to separate the cap top 102 from the cap base 104. For instance, the cap top 102 can translate between an open position and a closed position by pivoting in relation to the cap base 104. The integral hinge 106 (e.g., serving as a hinge to the cap top 102 and cap base 104) can be configure to enable the cap top 102 to move from the closed position to the open position while maintaining a connection to the cap base 104. While the FIGS.

1A-B depict the integral hinge 106 with a bow-tie (e.g., butterfly) geometry, alternate geometries are also envisaged. For example, the integral hinge 106 can embody any polygonal geometry, such as a rectangular geometry.

The cap base 104 of the hinge cap 100 is configured to engage a top portion of a container (not illustrated). For example, the cap base 104 can include interior threads (not illustrated), configured to engage complementary exterior threads of the container.

The hinge cap 100 (e.g., the cap top 102, cap base 104, and/or integral hinge 106) can be composed of a plastic material (e.g., polycarbonate "PC", polyethylene terephthalate "PET", polyethylene "PE", polypropylene "PP", acrylonitrile butadience styrene "ABS", thermoplastic elastomers "TPE", thermoplastic polyurethane "TPU", a polyolefin, a combination thereof, and/or the like) formed to a defined shape via an injection molding operation. For instance, the cap top 102, cap base 104, and/or integral hinge 106 can be formed simultaneously (e.g., as a single piece of material). In one or more embodiments, the cap top 102 and the cap base 104 can be composed of the same plastic material. In various embodiments, the cap top 102 and the cap base 104 can be composed of different plastic materials. Additionally, the integral hinge 106 can be composed of the same plastic material as the cap top 102 and/or the cap base 104. Alternatively, the integral hinge 106 can be composed of a first plastic material, while the cap top 102 and the cap base 104 are composed of a second, different plastic material. For example, the hinge cap 100 can be formed via multi-shot (e.g., two-shot) injection molding process (e.g., with a first shot of molten plastic material provided to form the cap top 102 and/or cap base 104, and a second shot of molten plastic material provided to form the integral hinge 106).

Further, the hinge cap 100 can be processed in accordance with one or more embodiments described herein to achieve metallization over the entire, or nearly the entire, surface of the cap top 102 and/or cap base 104. For example, the top sidewall 103 and/or base sidewall 105 can be metallized via a metallization process, such that a metal film is deposited onto the surfaces of the hinge cap 100. In one or more embodiments, the metallization process can deposit a metal film onto the hinge cap 100 with a thickness ranging, for example, from greater than or equal to several Angstroms (e.g., about 0.01 microns) to less than or equal to several nanometers (e.g., about 20 microns). In various embodiments, the thickness of the metal film can be uniform, or substantially uniform, across the surface of the hinge cap 100. Additionally, the metal film can be continuous, or substantially continuous, with exception to targeted areas (e.g., with exception to the integral hinge 106, a central portion 120 of the integral hinge 106, and/or a patterned portion 122 of the integral hinge 106 in accordance with one or more embodiments described herein).

Additionally, the hinge cap 100 can be processed such that the there is no, or nearly no, metallization or only partial metallization on the integral hinge 106 of the hinge cap 100 (e.g., as illustrated in FIGS. 1A-3C). For instance, FIGS. 1A-B depicts an example embodiment in which a deposited metal film (e.g., depicted via grey shading) is absent from the integral hinge 106. The absence of the metal film, or partial absence thereof, can enable the integral hinge 106 to bend and flex (e.g., to permit the cap top 102 to pivot with respect to the cap base 104) without degradation (e.g., flaking) of the metal film applied to the cap top 102 and/or cap base 104. This allows the hinge cap 100 to retain its premium look during the lifetime of the associated product.

In one or more embodiments, the metal film can be restricted to portions of the integral hinge 106. For example, the metal film can be absent from one or more central portions 120 of the integral hinge 106. FIGS. 2A-3C depict example embodiments in which the presence of a metal film on the integral hinge 106 is restricted from targeted areas (e.g., restricted from a central portion 120 of the integral hinge 106 and/or absent from a patterned portion 122 of the integral hinge 106). For instance, the portions of the deposited metal film can be selectively removed from the integral hinge 106 via one or more treatment operations (e.g., laser ablations). For instance, in some areas (e.g., such as areas of the integral hinge 106 with minimal flexing and/or bending) the metal film can remain present as there is minimal risk for degradation and flaking, while the metal film can be absent from other, targeted areas (e.g., such as areas prone to bending and/or deformation).

Figure 2A:
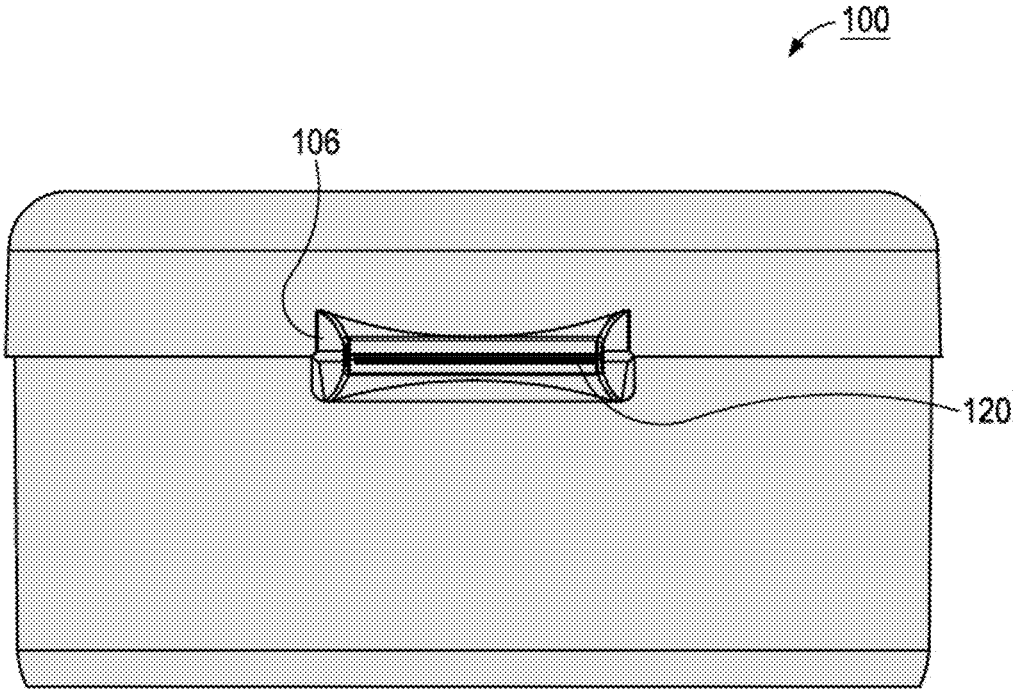
FIG. 2A illustrates a diagram of a side perspective of an example non-limiting hinge cap in accordance with one or more embodiments described herein.
Figure 2B:
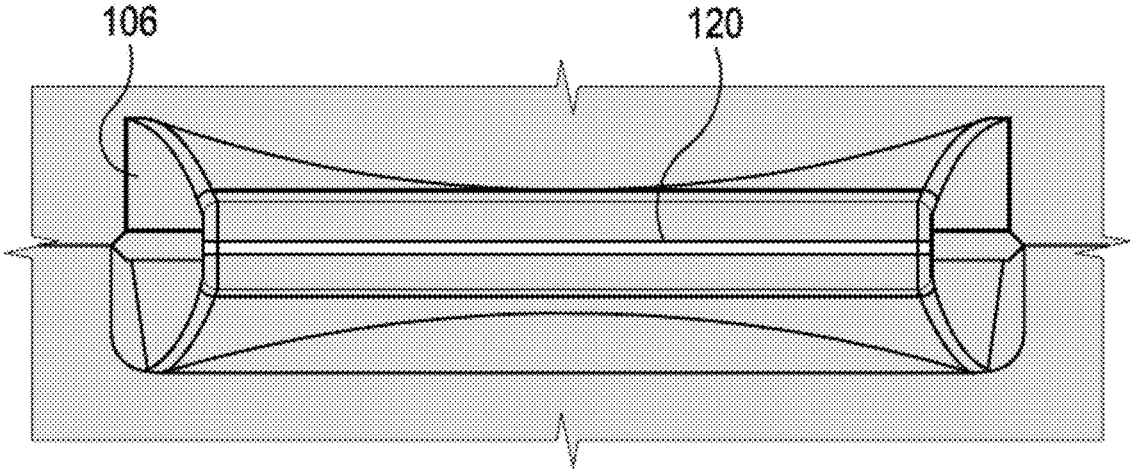
FIG. 2B illustrates a diagram of a magnified view of a non-limiting example living hinge in accordance with one or more embodiments described herein.

As shown in FIGS. 2A-2B, the metal film of the integral hinge 106 can be restricted (e.g., selectively removed) from a central portion 120 positioned along a center line of the integral hinge 106 (e.g., for example along a horizontal orientation, and/or longitudinal direction, of the integral hinge 106). In FIGS. 2A-2B, the central portion 120, lacking a metal film (e.g., depicted via grey shading), is presented via a bold black line. For example, the central portion 120 can be an area of the integral hinge 106 subject to deformation as the cap top 102 pivots with reference to the cap base 104. The central portion 120 can be subject to one or more treatment operations (e.g., laser ablation) to ensure removal of any metal film present at the central portion 120. For instance, an area about the center line (e.g., an axis at which the hinge 106 bends and the cap top 102 pivots) is treated such that the metal film about that central portion 120 is removed.

In one or more embodiments, the treatment operation can include removal of the metal film with a laser. Additionally, in one or more embodiments more than just the central portion 120 can be removed of the metal film (e.g., more than just the central portion 120 of the integral hinge 106 can be free of the metal film). For instance, the treatment operation can include utilizing a laser to define a raster-like pattern of the metal film, where the laser can traverse the integral hinge 106 in accordance with one or more defined travel routes (e.g., pre-defined patterns). As the laser traverses along the travel route, the laser can remove portions of the metal film located on the travel route. Thereby, areas of the integral hinge 106 that are absent the metal film can be arrange in a raster-like manner (e.g., where the path of the laser can follow travel routes that are substantially parallel or perpendicular to each other).

Figure 3A:
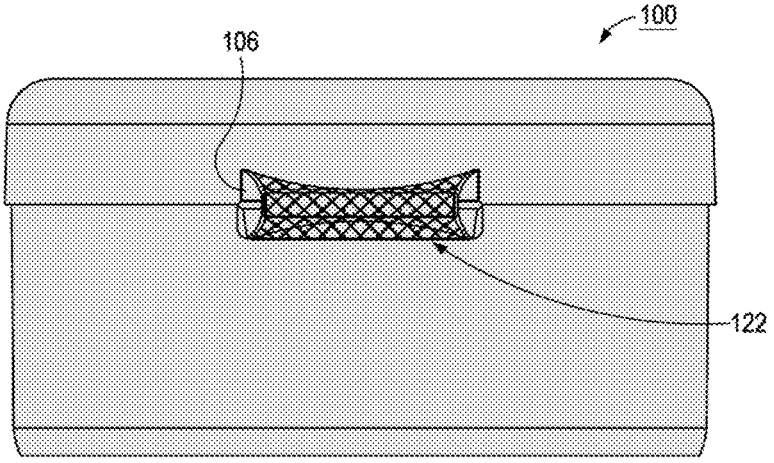
FIG. 3A illustrates a diagram of a side perspective a non-limiting example hinge cap in accordance with one or more embodiments described herein.
Figure 3B:
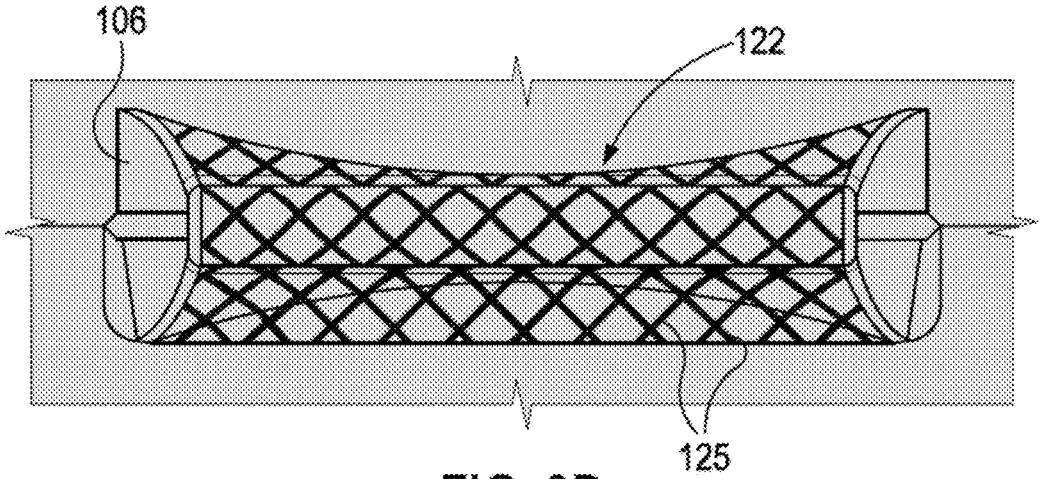
FIG. 3B illustrates a diagram of a magnified view of a non-limiting example living hinge in accordance with one or more embodiments described herein.
Figure 3C:
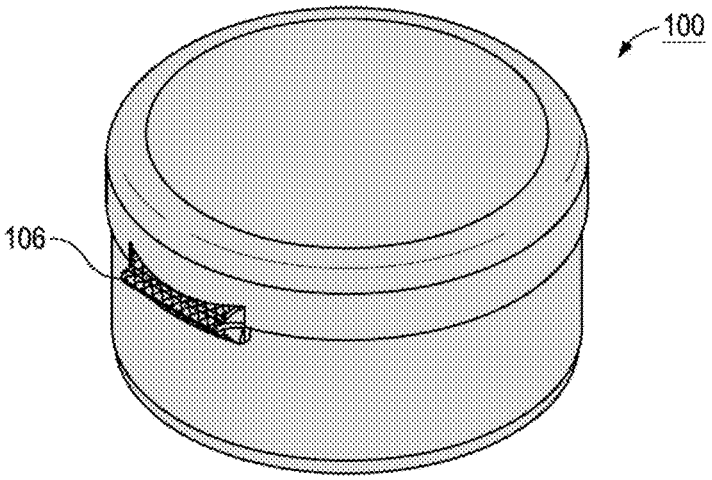
FIG. 3C illustrates a diagram of an example non-limiting hinge cap in accordance with one or more embodiments described herein.

In one or more embodiments, removal of the metallization from the hinge 106 may occur along a patterned portion 122 (e.g., a cross-hatch pattern) (e.g., as shown in FIGS. 3A-C). As shown in FIGS. 3A-3C, the bold lines of the patterned portion 122 (e.g., cross-hatch pattern) can depict areas of the integral hinge 106 that are free of the metal film (e.g., depicted via grey shading). For example, a laser can ablate the metal film from the integral hinge 106 to form a raster-like configuration, where the travel route of the laser can follow substantially parallel or intersecting path lines 125 to remove the metal film. In one or more embodiments, the laser, having a spot width, removes all the metal film from the integral hinge 106. In other embodiments, the laser can be configured to follow a pre-defined travel route to define the patterned portion 122 (e.g., cross-hatch pattern) or otherwise be configured such that the laser only removes desired areas of the metal film (e.g., removes the metal film only at the central portion 120).

In some further embodiments, the entire hinge cap 100 (e.g., including the integral hinge 106 after removal of the metal film) is coated with a top coat. The top coat can be a high solids base or water base composition comprising an ultraviolet "UV" or thermal solvent. The top coat can modify the sheen properties (e.g., gloss, matte, a combination thereof, and/or the like) of the hinge cap 100 and/or can provide a protectant layer for the underlying surfaces of the hinge cap 100 (e.g., a protectant for the underlying metal film and/or exposed portions of the integral hinge 106). Further, the top coat can be flexible, such that the top coat is not damaged when the integral hinge 106 is used (e.g., such that the top coat is not damaged do to the integral hinge 106 bending to facilitate a pivot of the cap top 102 with reference to the cap base 104). In some further embodiments, the top coat includes a colorant. The thickness of the top coat can range from, for example, greater than or equal to about 10 micron to less than or equal to about 15 microns. In some embodiments the top coat is an acrylic or acrylic-urethane lacquer.

Figure 4:
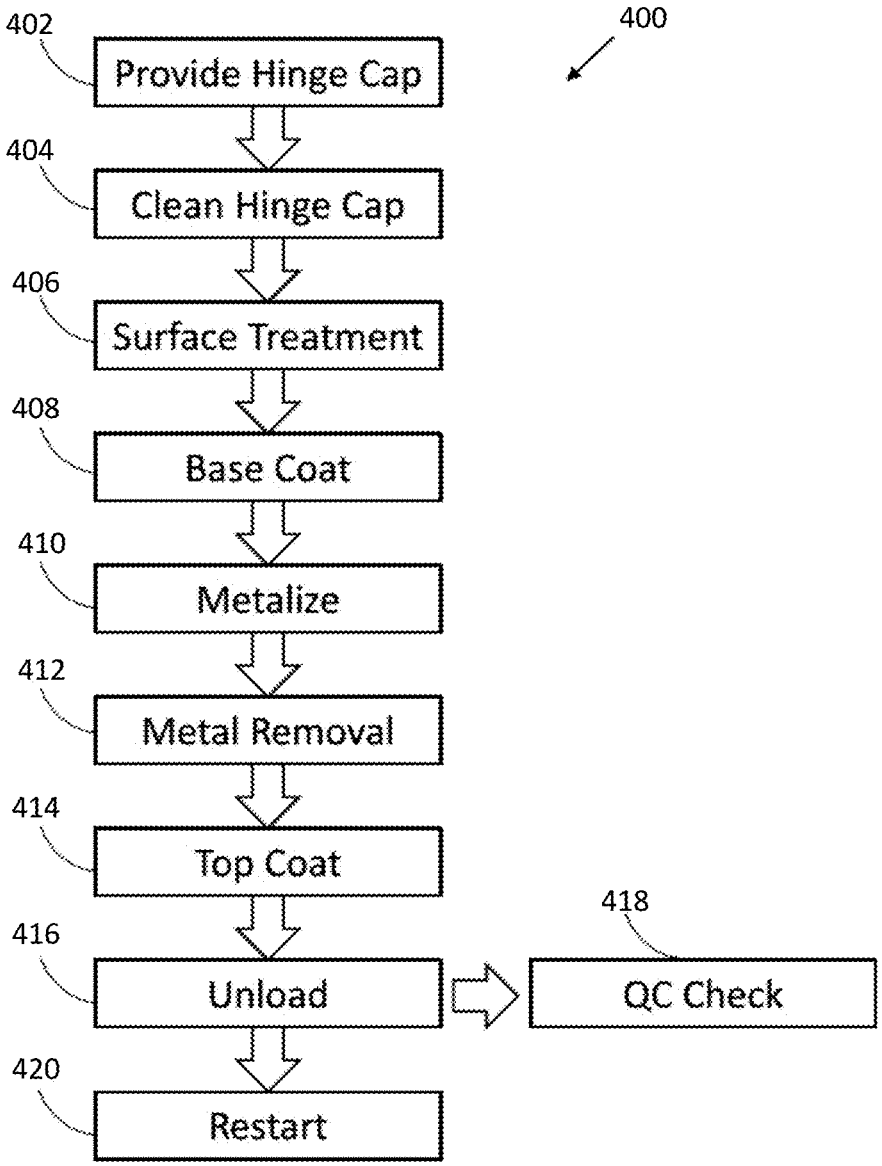
FIG. 4 is a flow diagram of an example method for manufacturing a hinge cap in accordance with one or more embodiments described herein.

FIG. 4 depicts a flow diagram of a non-limiting example method 400 for manufacturing the hinge cap 100 in accordance with one or more embodiments described herein. At 402, the method 400 can comprise providing a bare plastic hinge cap 100. As described herein, the hinge cap 100 can be composed of a plastic material (e.g., PC, PET PE, PP, ABS) formed via an injection molding operation with the cap top 102, cap base 104, and integral hinge 106 formed as a single piece. Providing the bare plastic hinge cap 100 at 402 can comprise loading the hinge cap 100 onto a mandrel of a processing system, and/or machine thereof, with the integral hinge 106 indexed. For example, the processing system can index the integral hinge 106 via optical indexing, or a technique similar thereto.

In one or more embodiments, providing the bare plastic hinge cap 100 at 402 can comprise forming the hinge cap 100 via an injection molding process or a multi-shot injection molding process. For example, a single-shot injection molding process can be employed to form the cap top 102, base cap 104, and integral hinge 106 of the same plastic material. In another example, a multi-shot injection molding process can be employed to form the cap top 102, base cap 104, and/or integral hinge 106 of two or more distinct plastic compositions. For instance, a two-shot injection molding process can be employed, where the cap top 102 and cap base 104 can be formed using a first plastic composition while the integral hinge 106 can be formed using a second plastic composition that is different from the first plastic composition.

The bare plastic hinge cap 100 is then pre-treated prior to receiving a metal film. Since metals tend to bond poorly with polymers, the pre-treatment ensures the metal properly adheres to the plastic. For example, the pre-treatment can be initiated at 404, where the bare plastic hinge cap 100 is cleaned. Cleaning techniques employed at 404 can include, but are not limited to: deionizing, air blowing, brushing, a combination thereof, and/or the like. The cleaning at 404 can remove contaminants and/or dust particles that could cause defects in subsequent application of the metal film and/or other coatings (e.g., a base coat and/or top coat).

At 406, the method 400 can further comprise a surface treatment for receiving one or more coatings as part of the pre-treatment process. The surface treatment processes employed at 406 can render the external surfaces of the hinge cap 100 more receptive to coating applications (e.g., the surface treatments can increase the hinge cap's 100 surface energy, thereby improving wettability and/or adhesion). Example surface treatments that can be utilized at 406 include, but are not limited to: flaming, plasma treatments, corona treatments, primer coating treatments, a combination thereof, and/or the like.

At 408, the method 400 can comprise applying a base coat to the entire, or nearly the entire, external surface area of the hinge cap 100 (e.g., to the pre-treated hinge cap 100). For example, the base coat can be applied utilizing a UV or thermal solvent to deliver a high solid or water based composition. In one or more embodiments, application of the base coat at 408 can facilitate a smooth and/or uniform finishing surface of a subsequent metal film, thereby reducing mold line visibility. The presence of the base coat on the hinge cap 100 can also improve adhesion between the plastic of the hinge cap 100 and deposited metal of a subsequent metallization process. In some embodiments, the base coat is an acrylic or acrylic-urethane lacquer. In some embodiments, the base coat can provide color to hide color defects in the underlying plastic material of the hinge cap 100 and/or to provide an alternative color under a transparent metal film.

At 410, the method 400 can comprise applying a metallization process to deposit a metal film (e.g., depicted via grey shading in FIGS. 1A-3C) onto the entire, or near entire, external surface of the hinge cap 100 (e.g., applying the metallization process onto the base coating). During the metallization process, a metal film is applied to and coat the surface of the hinge cap 100. Example metals that can compose the metal film (e.g., metals that can be deposited via the metallization process) include, but are not limited to: aluminum, bronze, brass, copper, stainless steel, nickel-chromium "Ni/Cr" alloys, other alloys thereof, combinations thereof, and/or the like. Example application processes that can be employed at 410 to apply the metal film as a part of the metallization process can include, but are not limited to: physical vapor deposition "PVD" (e.g., sputtering and evaporation), thermal vacuum processes, filament evaporation, electron-beam evaporation, flash evaporation, induction evaporation, a combination thereof, and/or the like.

In one or more embodiments, the metal film can be deposited onto the entire surface area of the integral hinge 106 via the metallization process. For example, the metal film can be deposited onto: an outward facing surface of the integral hinge 106 (e.g., facing away from the sidewall 103 of the cap top 102 and/or the sidewall 105 of the cap base 106), an inward facing surface of the integral hinge 106 (e.g., facing toward the sidewall 103 of the cap top 102 and/or the sidewall 105 of the cap base 106), and/or the sidewalls of the integral hinge 106. In some embodiments, the metal film can be selectively deposited onto a target surface of the integral hinge 106.

At 412 the method 400 can comprise removing the metal film from the integral hinge 106. With the integral hinge 106 indexed, the metal film can be removed with the precision of a laser. For example, a laser (e.g., a carbon dioxide "$CO_2$" laser, a yttrium aluminum garnet "YAG" laser, and/or the like) can be employed at 410 to ablate the metal film (and in some embodiments, the base coat and/or a top coat) from the integral hinge 106. In some embodiments, the entire surface area of the integral hinge 106 is ablated such that no metal film remains on the integral hinge 106 (e.g., as shown in FIGS. 1A-1B). In other embodiments, removing the metal film at 410 can comprise configuring the laser (e.g., programing a coupled laser guidance system) to ablate the metal film from targeted portions of the integral hinge 106, thereby enabling the integral hinge 106 to flex in areas where no metal film is present. FIGS. 2A-3C illustrate embodiments, where a laser has removed targeted portions of metal film on the integral hinge 106 in accordance with a raster-like pattern along programmed travel routes (e.g., along the central portion 120 and/or path lines 125). In one or more embodiments, removing the metal film at 412 can comprise defining the traveling route of the laser and/or defining the spot size of the laser to remove a desired amount of metal film from targeted areas from the integral hinge 106.

In one or more embodiments, the removal of the metal film at 412 (e.g., the laser ablation) can be applied to both the outward facing surface of the integral hinge 106 (e.g., facing away from the sidewall 103 of the cap top 102 and/or the sidewall 105 of the cap base 106) and the inward facing surface of the integral hinge 106 (e.g., facing toward the sidewall 103 of the cap top 102 and/or the sidewall 105 of the cap base 106). For example, the laser ablation can be performed via two operations of the laser: a first operation directed toward the outward surface of the integral hinge 106, and a second operation directed toward the inner surface of the integral hinge 106. For instance, the integral hinge cap 100 can be rotated between operations of the laser ablation. In another example, the laser ablation can be performed via two separate lasers: a first laser directed toward the outward surface of the integral hinge 106, and a second laser directed toward the inward surface of the integral hinge 106. Additionally, the travel routes of the one or more lasers can be the same on the outward and inward facing surfaces of the integral hinge 106. Alternatively, the travel route of the one or more lasers directed toward the outward facing surface of the integral hinge 106 can be different than the travel route of the one or more lasers directed toward the inner facing surface of the integral hinge 106. For example, the metal film can be removed from the central portion 120 on the outward facing surface of the integral hinge 106, while being removed from a patterned portion 122 on the inward facing surface of the integral hinge 106 (or vice versa).

At 414, the method 400 can comprise applying a top coat to the hinge cap 100. For example, the top coat can be a solid or water based composition comprising a UV or thermal solvent. The top coat can provide a protective layer to the underlying metal film and/or integral hinge 106 (e.g., can protect from scratching and/or corrosion). In some embodiments, the top coat can also provide an aesthetic surface finish (e.g., a matte or gloss appearance). Further, the top coat can also add color to the hinge cap 100.

In some embodiments, the method 400 comprises applying the top coat at 414 prior to applying the metallization process at 410 such that the laser removal executed after the metallization process can also be applicable to the top coat. Thereby, the laser ablation described herein can remove at least both the top coat and metal film on the integral hinge 106.

At 416, the method 400 can comprise unloading the hinge cap 100 from the processing system (e.g., the hinge cap 100 can be removed from the mandrel). Further, at 418 the method 400 can comprise subjecting unloaded hinge cap 100 to a quality control check and/or packaging for end use. At 420, method 400 can comprise repeating the manufacturing process for another batch of bare plastic hinge caps 100.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure.

The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

To aid the Patent Office and any readers of this application and any resulting patent in interpreting the claims appended hereto, applicants do not intend any of the appended claims or claim elements to invoke 35 U.S.C. 112 (f) unless the words "means for" or "step for" are explicitly used in the particular claim.

Additional Embodiments

The present disclosure is also directed to the following exemplary embodiments, which can be practiced in any combination thereof.

Embodiment 1: A method of manufacturing a metalized hinge cap, the method comprising: applying a metallization process to a hinge cap to deposit a metal film onto a cap top, cap base, and hinge of the hinge cap, wherein the hinge is integral with a first sidewall of the cap top, and wherein the hinge is integral with a second sidewall of the cap base; and removing the metal film from at least a portion of hinge via an ablation of the metal film.

Embodiment 2: The method of embodiment 1, wherein the removing the metal film is performed by laser ablating the metal film from an area of the hinge configured to bend during operation of the hinge cap.

Embodiment 3: The method of any of embodiments 1 or 2, wherein the laser ablating is restricted to a central portion of the hinge along a longitudinal axis of the hinge.

Embodiment 4: The method of any of embodiments 1-3, wherein the laser ablating removes the metal film along a defined pattern across a surface area of the hinge.

Embodiment 5: The method of any of embodiments 1-4, wherein the defined pattern is a cross-hatch pattern.

Embodiment 6: The method of embodiment 1, wherein the removing the metal film is performed by laser ablating the metal film from substantially an entirety of a surface area of the hinge.

Embodiment 7: The method of any of embodiments 1-6, forming the hinge cap via a multi-shot injection molding process, wherein the cap top and cap base are composed of a first plastic material, wherein the hinge is composed of a second plastic material, and wherein the first plastic material and the second plastic material have different compositions from each other.

Embodiment 8: The method of any of embodiments 1-7, wherein the hinge cap is composed of a plastic material, and wherein the method further comprises pre-treating a surface of the hinge cap to improve adhesion between the plastic material and the metal film.

Embodiment 9: The method of any of embodiments 1-8, wherein the pre-treating the surface of the hinge cap includes depositing a base coat onto the surface, and wherein the base coat comprises an acrylic or an acrylic-urethane composition.

Embodiment 10: A method of manufacturing a metalized hinge cap comprising: depositing a metal film onto a surface area of a hinge cap, wherein the metal film is deposited onto a cap top, base top, and integral hinge of the hinge cap; and laser ablating the integral hinge to remove a portion of the metal film, wherein the laser ablating follows a pre-defined travel route along the surface area of the hinge cap.

Embodiment 11: The method of embodiment 10, wherein the laser is a carbon dioxide laser or an yttrium aluminum garnet laser.

Embodiment 12: The method of any of embodiments 10 or 11, wherein the laser ablating removes the portion of the metal film from a targeted area of the integral hinge, and wherein the targeted area is an area of the integral hinge configured to bend during operation of the hinge cap.

Embodiment 13: The method of any of embodiments 10-12, wherein the pre-defined travel route defines a pattern of intersecting path lines on the integral hinge, and wherein the metal film is removed by the laser ablating along the path lines.

Embodiment 14: The method of any of embodiments 10 or 11, wherein the pre-defined travel route encompasses an entire surface area of the integral hinge.

Embodiment 15: A metalized hinge cap, comprising: a cap base coupled to a cap top by a hinge, wherein a first end of the hinge is integral with a sidewall of the cap base, and wherein a second end of the hinge is integral with a sidewall of the cap top; and a metal film positioned on a surface area of the cap top and a surface area of the cap base, wherein the metal film is absent from at least a portion of the hinge.

Embodiment 16: The metalized hinge cap of embodiment 15, wherein the cap base, the cap top, and the hinge are composed of a plastic material.

Embodiment 17: The metalized hinge cap of any of embodiments 15 or 16, wherein the metal film is absent from the hinge.

Embodiment 18: The metalized hinge cap of any of embodiments 15 or 16, wherein the metal film is absent from the hinge along a pre-defined pattern of parallel or intersecting path lines.

Embodiment 19: The metalized hinge cap of any of embodiments 15 or 16, wherein the metal film is absent from a central portion of the hinge along a longitudinal axis of the hinge.

Embodiment 20: The metalized hinge cap of any of embodiments 15-19, wherein the cap base and the cap top are composed of a first plastic material, wherein the hinge is composed of a second plastic material, and wherein the first plastic material is different than the second plastic material.

What is claimed is:

1. A metalized hinge cap, comprising:

a cap base coupled to a cap top by a hinge, wherein a first end of the hinge is integral with a sidewall of the cap base, wherein a second end of the hinge is integral with a sidewall of the cap top, and wherein the cap base, the cap top, and the hinge are integrally formed as a single piece of material; and a metal film positioned on a surface area of the cap top and a surface area of the cap base, wherein the metal film is absent from at least a portion of the hinge.

2. The metalized hinge cap of claim 1, wherein the cap base, the cap top, and the hinge are composed of a plastic material.

3. The metalized hinge cap of claim 1, wherein the metal film is absent from the hinge.

4. The metalized hinge cap of claim 1, wherein the metal film is absent from the hinge along a pre-defined pattern of parallel or intersecting path lines.

5. The metallized hinge cap of claim 1, wherein the metal film is absent from a central portion of the hinge along a longitudinal axis of the hinge.

6. The metalized hinge cap of claim 1, wherein the cap base and the cap top are composed of a first plastic material, wherein the hinge is composed of a second plastic material, and wherein the first plastic material is different than the second plastic material.

* * * * *